US011395052B2

(12) United States Patent
Suzuki et al.

(10) Patent No.: US 11,395,052 B2
(45) Date of Patent: Jul. 19, 2022

(54) ELECTRONIC COMPONENT MODULE, COMBINATION OF ELECTRONIC COMPONENT MODULE AND CASING, AND CONTROL DEVICE INCLUDING THE COMBINATION

(71) Applicants: NIPPON SEIKI CO., LTD., Nagaoka (JP); HOSIDEN CORPORATION, Yao (JP)

(72) Inventors: Toshiaki Suzuki, Nagaoka (JP); Tsuyoshi Kawaguchi, Nagaoka (JP); Masahide Suzuki, Yao (JP); Kota Onoyama, Yao (JP); Jun Miyajima, Yao (JP)

(73) Assignee: Hosiden Corporation, Yao (JP)

( * ) Notice: Subject to any disclaimer, the term of this patent is extended or adjusted under 35 U.S.C. 154(b) by 372 days.

(21) Appl. No.: 16/803,373

(22) Filed: Feb. 27, 2020

(65) Prior Publication Data

US 2020/0296494 A1 Sep. 17, 2020

(30) Foreign Application Priority Data

Mar. 13, 2019 (JP) ..... JP2019-046026

(51) Int. Cl.

| | |
|---|---|
| ***H04R 1/02*** | (2006.01) |
| ***H04R 1/06*** | (2006.01) |
| ***H04R 9/02*** | (2006.01) |

(52) U.S. Cl.

CPC ..... *H04R 1/025* (2013.01); *H04R 1/023* (2013.01); *H04R 1/026* (2013.01); *H04R 1/06* (2013.01); *H04R 9/025* (2013.01); *H04R 2201/02* (2013.01)

(58) Field of Classification Search

CPC ..... H04R 1/025; H04R 1/023; H04R 1/026; H04R 1/06; H04R 9/025; H04R 2201/02

USPC ..... 367/679.47

See application file for complete search history.

(56) References Cited

U.S. PATENT DOCUMENTS

| | | | | |
|---|---|---|---|---|
| 2016/0014525 A1* | 1/2016 | Park | H01L 41/0906 | 381/190 |
| 2016/0173977 A1* | 6/2016 | Lim | G10L 21/0216 | 381/334 |
| 2021/0250697 A1* | 8/2021 | Qi | H04R 9/025 | |

FOREIGN PATENT DOCUMENTS

JP 2011-088609 A 5/2011

* cited by examiner

*Primary Examiner* — Sean H Nguyen
(74) *Attorney, Agent, or Firm* — Kilyk & Bowersox, P.L.L.C.

(57) ABSTRACT

An electronic component module including a fixing part, a function part housed in, or fixed to, the fixing part, at least one connection line, and at least one protrusion on the function part or the fixing part. The fixing part includes an abutting face, an outer face extending from an end of the abutting face in a direction including a component of a first direction, and an edge line along which the abutting and outer faces meet. The connection line is flexible, electrically connected to the function part, positioned on a second direction side relative to the abutting face, and configured to be led out in a third direction from an inside to an outside relative to the edge line. The protrusion extends at least partly in the third direction and is positioned at least partly on the first direction side relative to the connection line in the led-out state.

20 Claims, 12 Drawing Sheets

ELECTRONIC COMPONENT MODULE, COMBINATION OF ELECTRONIC COMPONENT MODULE AND CASING, AND CONTROL DEVICE INCLUDING THE COMBINATION

CROSS-REFERENCE TO RELATED APPLICATION

The present application claims priority under 35 U.S.C. § 119 of Japanese Patent Application No. 2019-046026 filed on Mar. 13, 2019, the disclosure of which is expressly incorporated by reference herein in its entirety.

BACKGROUND OF THE INVENTION

Technical Field

The invention relates to an electronic component module, a combination of the electronic component module and a casing, and a control device including the combination.

Background Art

Japanese Unexamined Patent Publication No. 2011-88609 describes a conventional control device. This device is an information provision device for vehicles including a speaker module, a casing, a circuit board, and a controller. The speaker module has a speaker body, a frame to which the speaker body is fixed, and a connection line connected to the speaker body. The speaker body is arranged in an opening of the casing, and the frame is fixed to an edge of the opening of the casing. The circuit board is arranged in the casing and connected to the connection line. The controller is mounted on the circuit board and controls driving of the speaker body via the circuit board and the connection line.

SUMMARY OF INVENTION

In the conventional control device, the connection line is electrically and mechanically connected to the speaker body and hangs down from the speaker body. Therefore, when placing the speaker body into the opening of the casing and fixing the frame to the edge of the casing, the connection line may partly enter between the frame and the edge of the casing and become pinched therebetween.

The invention provides an electronic component module with a reduced risk of a connection line becoming pinched. The invention also provides a combination of the electronic component module and a casing, and a control device including the combination.

An electronic component module according to an aspect of the invention includes a fixing part being a frame or a circuit board, a function part being configured to function as an electronic component, at least one connection line, and at least one protrusion. The fixing part includes an abutting face, an outer face extending from an end of the abutting face in a direction including a component of a first direction, and an edge line along which the abutting face and the outer face meet. The first direction is substantially orthogonal to the abutting face. The function part is housed in, or fixed to, the fixing part. The at least one connection line is flexible and electrically connected to the function part. The at least one connection line is positioned on a second direction side relative to the abutting face of the fixing part, and configured to be led out from an inside to an outside relative to the edge line of the fixing part to extend in a third direction. The second direction is opposite to the first direction, and the third direction crosses the first and second directions. The at least one protrusion is provided on the function part or the fixing part, extends at least partly in the third direction, and is positioned at least partly on the first direction side relative to the at least one connection line having been led out in the third direction.

In the electronic component module of this aspect, since the at least one protrusion is positioned at least partly on the first direction side relative to the at least one connection line having been led out in the third direction, the electronic component module can be mounted to a casing with a reduced risk that the at least one connection line becomes pinched between the abutting face of the electronic component module and a first edge portion of the housing hole of the casing on the first direction side, and/or between the electronic component module and a side wall of a housing hole of the casing. To mount such electronic component module to a casing, the electronic component module can be tilted such that the at least one protrusion faces a second edge portion of the housing hole of the casing on the second direction side or faces at least one engaging portion provided on the side wall of the housing hole; in this state, the at least one connection line can be inserted into the housing hole; and then the at least one protrusion can be inserted into the housing hole so as to be positioned on the second direction side relative to the second edge portion or the engaging portion of the casing; with this state maintained, the electronic component module can be partly housed in the housing hole, and the abutting face of the electronic component module is brought into abutment with the first edge portion.

If an attempt is made to bring the abutting face into abutment with the first edge portion of the casing from the first direction side without tilting the electronic component module as described above, the at least one protrusion will abut against the first edge portion of the casing before the at least one connection line becomes pinched between the abutting face and the first edge portion of the casing. This is because the at least one protrusion is at least partly positioned on the first direction side relative to the at least one connection line having been led out in the third direction. It is therefore possible to reduce the risk that the at least one connection line becomes pinched between the abutting face of the electronic component module and the first edge portion of the casing.

The at least one protrusion may be partly positioned on the second direction side relative to the at least one connection line having been led out in the third direction. In the electronic component module of this aspect, if an attempt is made to bring the abutting face into abutment with the first edge portion of the casing from the first direction side without tilting the electronic component module, the at least one protrusion is more likely to abut against the first edge portion of the casing before the at least one connection line will. This is because the at least one protrusion is partly positioned on the second direction side relative to the at least one connection line having been led out in the third direction. It is therefore possible to further reduce the risk that the at least one connection line becomes pinched between the abutting face and the first edge portion of the casing.

The at least one protrusion may extend in the third direction, from an inside to an outside relative to the edge line of the fixing part. In the electronic component module of this aspect, if an attempt is made to bring the abutting face into abutment with the first edge portion of the casing from the first direction side without tilting the electronic component module, the at least one protrusion is more likely to abut against the first edge portion of the casing before the at least one connection line becomes pinched between the abutting face and the first edge portion of the casing. This is because the at least one protrusion extends in the third direction, from the inside to the outside relative to the edge line of the fixing part.

The fixing part may further include a flange. The flange may include the above abutting face, the above outer face, and the above edge line.

The electronic component module according to any of the above aspects may further include a retainer positioned on the second direction side relative to the abutting face. The retainer may retain the at least one connection line partly such that the at least one connection line is led out in the third direction from an inside to an outside relative to the edge line. The at least one connection line may include a retained portion to be retained by the retainer. The at least one protrusion may be positioned in a vicinity of the retained portion of the at least one connection line and at least partly positioned on the first direction side relative to the retained portion of the at least one connection line.

In the electronic component module of this aspect, the at least one protrusion is at least partly positioned in the vicinity of the retained portion of the at least one connection line and on the first direction side relative to the retained portion of the at least one connection line. This arrangement further reduces the risk that the at least one connection line is pinched between the abutting face and the first edge portion of the casing and/or between the electronic component module and the side wall of the housing hole when tilting the electronic component module and bringing the abutting face into abutment with the first edge portion of the casing from the first direction side.

The at least one connection lines may be provided as a plurality of connection lines. In this case, the or each protrusion may be positioned between two of the connection lines.

The at least one protrusion may be provided as two protrusions. In this case, the two protrusions may be arranged on opposite sides of the at least one connection line.

The at least one protrusion may include an opposing face opposing the abutting face. The opposing face of the at least one protrusion may curve or incline such that a distance between the opposing face and the abutting face gradually increases in the third direction. The electronic component module of this aspect facilitates the insertion of the at least one protrusion into the housing hole so as to place the at least one protrusion on the second direction side relative to the second edge portion or the engaging portion of the casing.

A combination of an electronic component module and a casing of an aspect of the invention includes the electronic component module of any of the above aspects and a casing. The casing includes a housing hole opening to the first direction side, a first edge portion of the housing hole on the first direction side, and a second edge portion of the housing hole on the second direction side. The first and second edge portions, or alternatively the first edge portion and the engaging portion, are positioned between the abutting face and the at least one protrusion in a state where the electronic component module is partly housed in the housing hole from the first direction side and the abutting face of the electronic component module abuts the first edge portion of the housing hole from the first direction side. The combination of this aspect provides one or more of the effects as described earlier in relation to the electronic component module of the above aspects.

A control device of an aspect of the invention includes the combination of any of the above aspects, a main circuit board, and a controller mounted on the main circuit board. The main circuit board is positioned on the second direction side relative to the casing and connected to the at least one connection line of the electronic component module. The controller is mounted on the main circuit board and configured to output a signal to, and/or receive a signal from, the function part of the electronic component module via the main circuit board and the at least one connection line.

BRIEF DESCRIPTION OF DRAWINGS

The present invention can be even more fully understood with the reference to the accompanying drawings which are intended to illustrate, not limit, the present invention.

DESCRIPTION OF EMBODIMENTS

Various embodiments of the invention will be described below. It should be noted that elements of the embodiments and their variants described below may be combined in any possible manner.

First Embodiment

Figure 5:
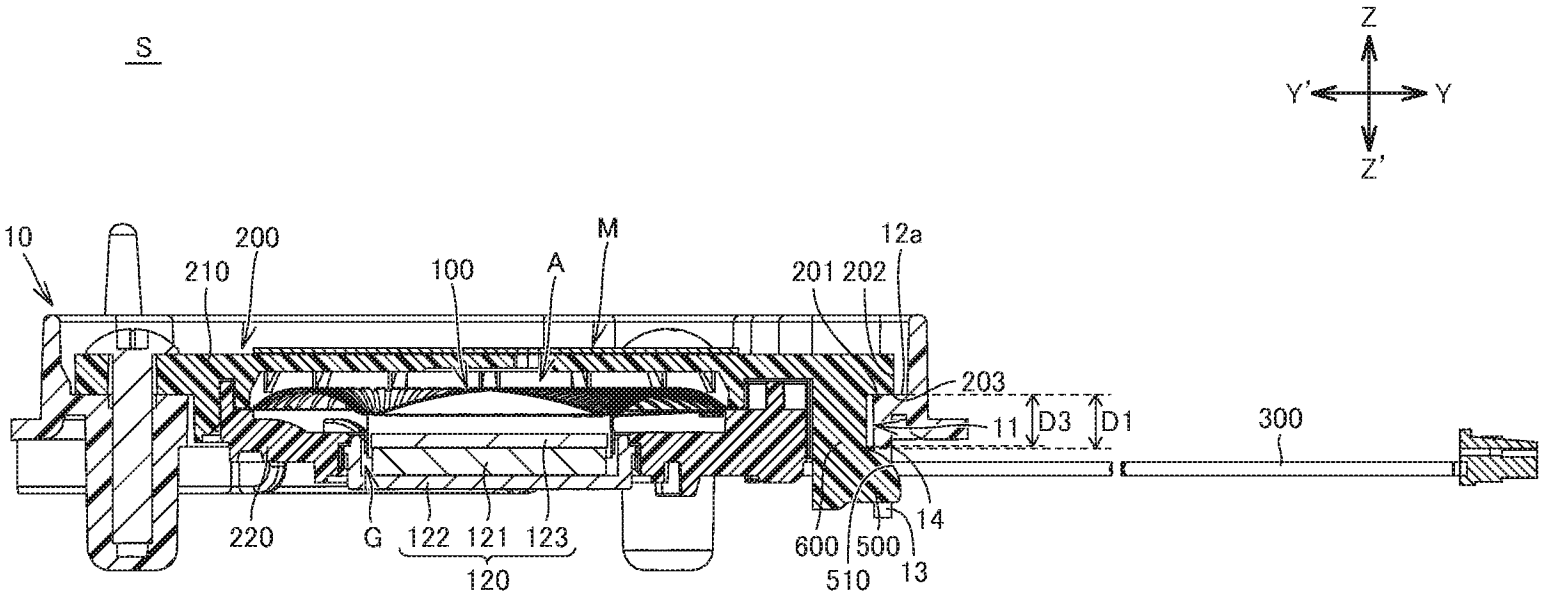
FIG. 5 is a cross-sectional view, corresponding to FIG. 1C, of a first variant of the combination.
Figure 6:
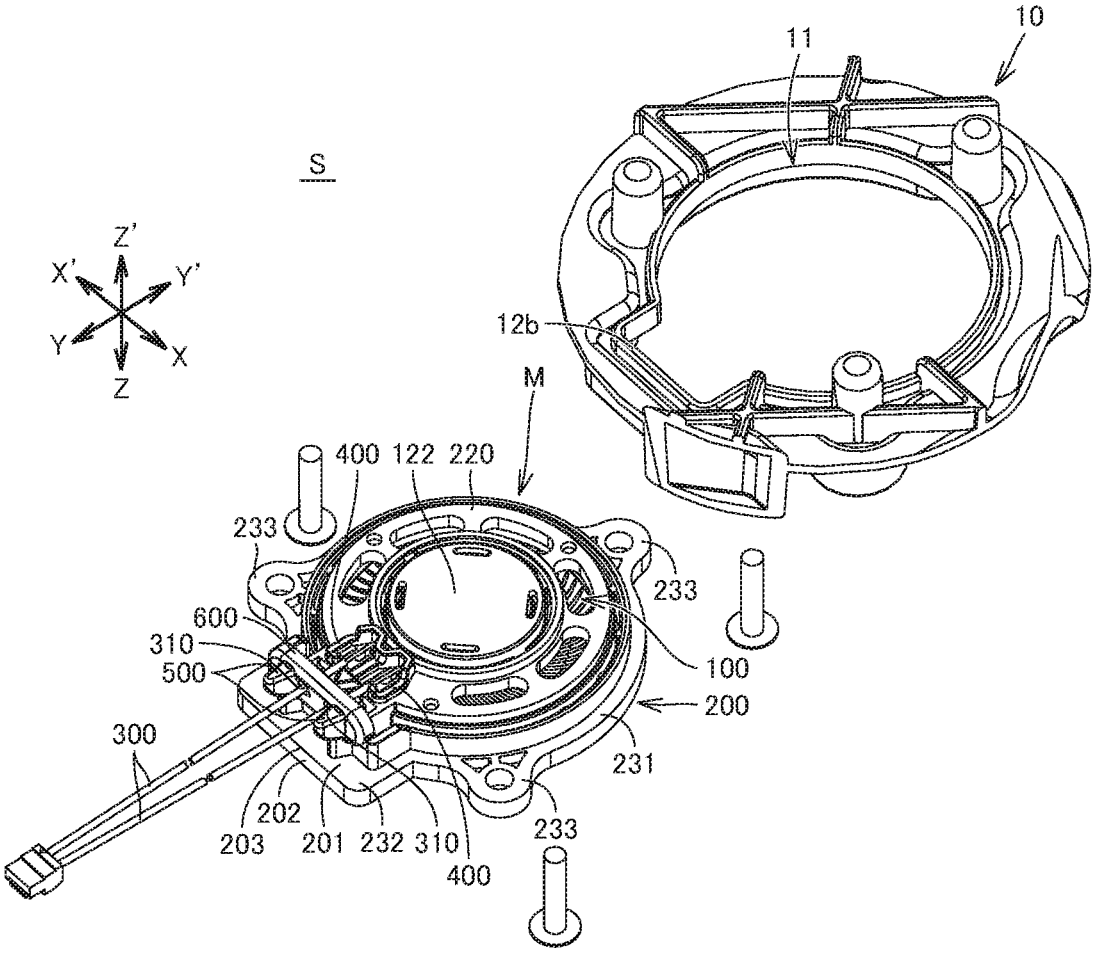
FIG. 6 is a front, bottom, left side perspective view of a second variant of the combination, showing a state before the electronic component module is mounted to the casing.

The following describes a combination S of an electronic component module M and a casing 10 (attachment structure S) according to a plurality of embodiments of the invention, including the first embodiment and its variants, with reference to FIGS. 1A to 6. FIGS. 1A to 4B show the combination S of the first embodiment. FIG. 5 shows a first variant of the combination S of the first embodiment. FIG. 6 shows a second variant of the combination S of the first embodiment.

The combination S includes the casing 10 and the electronic component module M (which may be referred to simply as a module M) to be mounted to the casing 10. FIGS. 1C to 3A and FIGS. 4A to 6 show a Z-Z' direction. The Z-Z' direction includes a Z direction and a Z' direction opposite to the Z direction. The Z direction corresponds to a first direction, and the Z' direction corresponds to a second direction. FIGS. 1C to 3A and 4A to 6 show a Y-Y' direction, which is substantially orthogonal to the Z-Z' direction. The Y-Y' direction includes a Y direction and a Y' direction opposite to the Y direction. The Y direction may correspond to a third direction. FIGS. 2A, 2B, 4A, 4B, and 6 show an X-X' direction orthogonal to the Y-Y' and Z-Z' directions.

The casing 10 has a housing hole 11, and a first edge portion 12*a* of the housing hole 11 on the Z-direction side. The housing hole 11 may be a through hole extending through the casing 10 and opening to the Z- and Z'-direction sides (as shown in FIGS. 1C to 2B) or may be a blind hole opening to the Z-direction side.

Where the housing hole 11 is a through hole, the casing 10 may further include a second edge portion 12*b* of the housing hole 11 on the Z'-direction side (see FIG. 1C), or may further include at least one engaging portion on the or a side wall of the housing hole 11 (i.e. on the or an inner wall of the casing 10). Where the side wall of the housing hole 11 has a depression or hole (an engaging hole 13), the at least one engaging portion may particularly be an edge portion on the Z-direction side (third edge portion 14) of the engaging hole 13, for example (see FIG. 5). In this case, the at least one engaging hole 13 and the third edge portion 14 thereof are arranged on the Z'-direction side relative to the first edge portion 12*a*.

Where the housing hole 11 is a blind hole, it is preferable that the casing 10 further have the at least one engaging hole 13 and the third edge portion 14 thereof described above.

The at least one engaging hole 13 may particularly be a plurality of engaging holes 13. The or each engaging hole 13 may be provided with a third edge portion 14.

The module M includes a function part 100 that performs a function as the module M. The function part 100 may be configured to function as a speaker as shown in FIGS. 1A to 6, a microphone, a sensor, a connector, an active component, a passive component, a circuit board, and/or the like, for example. The sensor may particularly be a touchscreen, an acceleration sensor, a touch switch, a motion detector, or the like. The active component may particularly be a semiconductor device, an electric motor, or the like. The passive component may particularly be a resistor, a capacitor, a coil, a transformer, a relay, a piezoelectric element, an oscillator, or the like.

Where the function part 100 is a speaker, the function part 100 includes a vibratable unit 110 and a magnetic circuit 120 (see FIGS. 1A to 6). The vibratable unit 110 includes a vibratable member 111, a coil bobbin 112, and a voice coil 113. The vibratable member 111 is a thin plate made of paper, synthetic resin, metal, ceramic, or other material. The coil bobbin 112 is of a tubular shape with a circular cross-section, fixed to the vibratable member 111, and arranged on the Z'-direction side relative to the vibratable member 111. The voice coil 113 is fixed to and along the outer circumferential surface of the coil bobbin 112. The magnetic circuit 120 is arranged on the Z'-direction side relative to the vibratable member 111. The magnetic circuit 120 includes a magnet 121, a yoke 122, and a pole piece 123. The yoke 122 is a close-bottomed tube including a bottom and a side wall with a circular cross-section. The side wall extends in the Z-Z' direction from the outer circumference of the bottom. The magnet 121 is disposed on the bottom of the yoke 122. The pole piece 123 is placed on the magnet 121 to be located within the yoke 122. A tubular magnetic gap G is formed between the side wall of the yoke 122 and the combination of the magnet 121 and the pole piece 123. The coil bobbin 112 and the voice coil 113 are arranged within and along the magnetic gap G.

The module M further includes a fixing part. The fixing part may particularly be a frame 200 made of synthetic resin or other material. The frame 200 may be configured to house the function part 100 therein. For example, the frame 200 may include a housing portion A of any of the following aspects (1) to (3).

(1) The frame 200 includes a first frame 210 and a second frame 220. The first and second frames 210, 220 may be combined together in the Z-Z' direction (see FIGS. 1A to 6) and may be fixed together with an adhesive or other means. The first frame 210 and/or the second frame 220 are provided with the housing portion A. The housing portion A houses the function part 100.

The first and second frames 210, 220 shown in FIGS. 1A to 4B further have the following configurations, but the invention is not limited thereto.

The first frame 210 is provided with a first housing recess 211 opening in the Z' direction.

The second frame 220 is provided with a second housing recess 221 opening in the Z direction and communicating with the first housing recess 211. The bottom of the second housing recess 221 is provided with a cylindrical opening 222. The first housing recess 211, the second housing recess 221, and the opening 222 constitute the housing portion A. The outer rim of the vibratable member 111 of the function part 100 is held between the circumferential area of the first housing recess 211 of the first frame 210 and the circumferential area of the second housing recess 221 of the second frame 220, so that the vibratable member 111 is housed in the first housing recess 211. The coil bobbin 112 and the voice coil 113 are housed in the second housing recess 221 and the opening 222 to be located in and along the magnetic gap G of the magnetic circuit 120 arranged in the opening 222. The side wall of the yoke 122 of the magnetic circuit 120 may be fixed directly to the inner wall of the opening 222 with an adhesive R or other means (see FIGS. 1C and 3A to 4B), or may be fixed indirectly to the inner wall of the opening 222 via another member interposed between the inner wall of the opening 222 and the side wall of the yoke 122 of the magnetic circuit 120. For convenience of illustration, the adhesive R is not illustrated In FIG. 1C.

(2) The housing portion A of the frame 200 may be a blind hole opening in the Z' direction. The function part 100 is housed in the housing portion A of the frame 200.

(3) The function part 100 may be housed in the frame 200 by insert molding or other means. In this case, the housing portion A is the portion of the frame 200 that the function part 100 is embedded in.

It should be noted that the function part 100 may not be housed in the frame 200 but fixed to the frame 200.

The frame 200 may include a body and at least one flange 230. The body has a greater dimension in the Z-Z' direction than the or each flange 230.

Where the function part 100 is housed in the frame 200, the body of the frame 200 may form at least part of the housing portion A, as described below as non-limiting examples.

Where the frame 200 has configuration (1) described above, at least one of the first frame 210 and the second frame 220 includes the body of the frame 200. Where the first frame 210 includes the body, the body may include part of the housing portion A (e.g., the first housing recess 211). Where the second frame 220 includes the body, the body may include part of the housing portion A (e.g., the second housing recess 221 and the opening 222). Where the first frame 210 and the second frame 220 include the body, the body may include the housing portion A.

Where the frame 200 has configuration (2) or (3) described above, the body may include the housing portion A.

Where the function part 100 is fixed to the frame 200, the body may include the portion of the frame 200 that the function part 100 is fixed to.

The at least one flange 230 extends from the body of the frame 200, at least in the Y direction. The at least one flange 230 may have any of the following configurations (a) to (d), for example.

(a) There is provided a single flange 230 extending from the body of the frame 200, in the Y direction.

(b) There is provided a plurality of the flanges 230 extending from the body. One of the flanges 230 extends in the Y direction, and the remaining one, or each of the remaining ones, extends in a direction (except the Y direction) substantially orthogonal to the Z-Z' direction.

(c) There is provided a single flange 230 including a ring 231 of generally ring shape. The ring 231 extends along the body of the frame 200 in a circumferential direction substantially orthogonal to the Z-Z' direction.

(d) The flange 230 of configuration (c) may be modified to further include at least one extension. The or each extension extends from the ring 231 in a direction substantially orthogonal to the Z-Z' direction.

In the embodiment as shown FIGS. 1A to 4B, there is provided a single flange 230 including a ring 231, an extension 232, and three extensions 233. The three extensions 233 are provided at 120° intervals along the ring 231. The extension 232 is positioned between two of the three extensions 233 and extends from the ring 231 in the Y direction.

The frame 200 further includes an abutting face 201, an outer face 202, and an edge line 203 along which the abutting face 201 and the outer face 202 meet. The abutting face 201 is a face that is abuttable, from the Z-direction side, with the first edge portion 12*a* of the casing 10 of the frame 200. With the abutting face 201 abutting the first edge portion 12*a* of the casing 10, the frame 200 is fixed to the first edge portion 12*a* by fixing means, such as screwing, adhesion with an adhesive or double-sided adhesive tape, or fitting. The fitting may particularly be such that one or more projections provided on one of the abutting face 201 and the first edge portion 12*a* are fittingly engaged with corresponding recess or recesses provided on the other. The outer face 202 faces generally to the Y-direction side and may particularly be a flat face, a face having an arc-shaped section, a concave face, a convex face, a concave-convex face, or other face. The outer face 202 extends from the distal end of the abutting face 201, generally in a direction including a component of the Z direction. Particularly, the outer face 202 may extend orthogonally to the abutting face 201. Alternatively, the outer face 202 may extend diagonally to the abutting face 201, substantially diagonally to the abutting face 201, in a direction including components of the Z and Y directions (this direction may be referred to as a "ZY direction"), or in a direction including components of the Z and Y' directions (this direction may be referred to as a "ZY' direction"). The Z-Z' direction is substantially orthogonal to the abutting face 201.

Where the frame 200 includes no flanges 230, the outer perimeter portion of the frame 200 may include the abutting face 201, the outer face 202, and the edge line 203.

Where the frame 200 includes the at least one flange 230, the at least one flange 230 may include the abutting face 201, the outer face 202, and the edge line 203, particularly as detailed below.

In the case of configuration (a) or (c) described above, the single flange 230 may include the abutting face 201, the outer face 202, and the edge line 203.

In the case of configuration (b) described above, the one of the flanges 230 that extends in at least the Y direction may include the abutting face 201, the outer face 202, and the edge line 203.

In the case of configuration (d) described above, the ring 231 of the single flange 230 may include the abutting face 201, the outer face 202, and the edge line 203. Alternatively, the single extension of the flange 230 may include, or the plurality of extensions may collectively include, the abutting face 201, the outer face 202, and the edge line 203. Still alternatively, the ring 231 and the extension or extensions may collectively include the abutting face 201, and the extension may include, or the plurality of extensions may collectively include, the outer face 202 and the edge line 203.

In the embodiment as shown in FIGS. 1A to 4B, it is the ring 231, the extension 232, and the three extensions 233 of the flange 230 that collectively include the abutting face 201, and it is the extension 232 that includes the outer face 202 and the edge line 203.

The module M further includes at least one connection line 300 electrically connected to the function part 100. The or each connection line 300 is a cable, a lead wire, a cord, or the like that is flexible enough to hang down under its own weight, for example. The at least one connection line 300 may be connected directly to the function part 100, or indirectly to the function part 100 via an intervening member, which may be a conductive connecting member (such as a terminal or a pin) retained by the frame 200. The at least one connection line 300 is positioned on the Z'-direction side relative to the abutting face 201 and configured to be led out in the Y direction, from the inside to the outside relative to the edge line 203. The number of the at least one connection line 300 may be appropriately determined depending on the type of the function part 100.

In the embodiment as shown in FIGS. 1A to 4B, there are two connection lines 300, two terminals 400, and two lead wires 113*a*. The connection lines 300 are embedded in the second frame 220 of the frame 200 by insert molding or other means and connected to the respective terminals 400. The terminals 400 are retained by the second frame 220 and also connected to the respective lead wires 113*a*. The lead wires 113*a* are drawn out from the voice coil 113.

The module M may further include a retainer 600. The retainer 600 may be provided integrally with the function part 100 or the frame 200. Alternatively, the retainer 600 may be provided separately from the function part 100 or the frame 200 and may be fixed to the function part 100 or the frame 200 by any of the fixing means described above. The retainer 600 is positioned on the Z'-direction side relative to the abutting face 201 of the frame 200, and retains the connection line or lines 300 partly such that the connection line or lines 300 are led out in the Y direction, from the inside to the outside relative to the edge line 203 of the frame 200. For example, the retainer 600 may have one or more through holes extending in the Y-Y' direction to receive therethrough the one or more connection lines 300 in the Y-Y' direction. Alternatively, the one or more connection lines 300 may be partly fixed to the end face on the Z'-direction side of the retainer 600 by any of the above fixing means such that the one or more connection lines 300 are led out in the Y direction, from the inside to the outside relative to the edge line 203.

In the embodiment as shown in FIGS. 1A to 4B, the retainer 600 is provided integrally with the abutting face 201 and has two through holes in accordance with the number of connection lines 300.

For convenience of explanation, the portion of the or each connection line 300 that is retained by the retainer 600 will be hereinafter referred to as a retained portion 310. The retainer 600 may be omitted.

The module M further includes at least one protrusion 500. The at least one protrusion 500 may be provided integrally with the function part 100 or the frame 200. Alternatively, the at least one protrusion 500 may be provided separately from the function part 100 or the frame 200 and may be fixed to the function part 100 or the frame 200 by any of the above fixing means. The at least one protrusion 500 may have any of the following configurations (i) to (iii), for example.

(i) Where the frame 200 includes the body, the or each protrusion 500 is provided on an outer face on the Y- or Z'-direction side of the body.

(ii) The or each protrusion includes has a first portion extending in the Z' direction from the abutting face 201 of the frame 200 and a second portion extending in the Y direction from the first portion.

(iii) Where the module M includes the retainer 600, the or each protrusion 500 is provided on the face on the Y-direction side (see FIGS. 1C and 3A) or on the Z'-direction side of the retainer 600. In this case, the at least one protrusion 500 is positioned in the vicinity of the retained portion 310 of the at least one connection line 300.

Configuration (iii) may be modified such that the module M includes the retainer 600, the at least one protrusion 500 is positioned in the vicinity of the retained portion 310 of the at least one connection line 300 and further include configuration (i) or (ii).

The at least one protrusion 500 is arranged at least partly on the Z-direction side relative to the one or more connection lines 300 having been led out in the Y direction. The or each protrusion 500 includes a top portion, which is the topmost portion to the Z-direction side of the protrusion 500. The top portion is located on the Z-direction side relative to the one or more connection lines 300 having been led out in the Y direction. Accordingly, the one or more connection lines 300 having been led out in the Y direction are not positioned in the Z-Z' direction between, i.e. are positioned in the Z-Z' direction outside the area between, the at least one protrusion 500 and the abutting face 201.

The at least one protrusion 500 may be partly positioned on the Z-direction side relative to the one or more connection lines 300 having been led out in the Y direction. In this case, the bottom portion, which is the bottommost portion to the Z'-direction side, of the at least one protrusion 500 is located on the Z'-direction side relative to the one or more connection lines 300 having been led out in the Y direction. In other words, the or each connection lines 300 having been led out in the Y direction is positioned next to, and on the X- or X'-direction side relative to, the or a respective protrusion 500, and positioned in the Z-Z' direction between the top portion and the bottom portion of the or the respective protrusion 500.

Alternatively, the bottom portion may be positioned at the same height in the Z-Z' direction as the end in the Z' direction of the one or more connection lines 300 having been led out in the Y direction. Still alternatively, the bottom portion may be positioned on the Z-direction side relative to the one or more connection lines 300 having been led out in the Y direction.

As used herein the phrase "one or more connection lines 300 having been led out in the Y direction" means a state in which the one or more connection lines 300 are led out and stretched tightly in the Y direction.

Figure 1A:
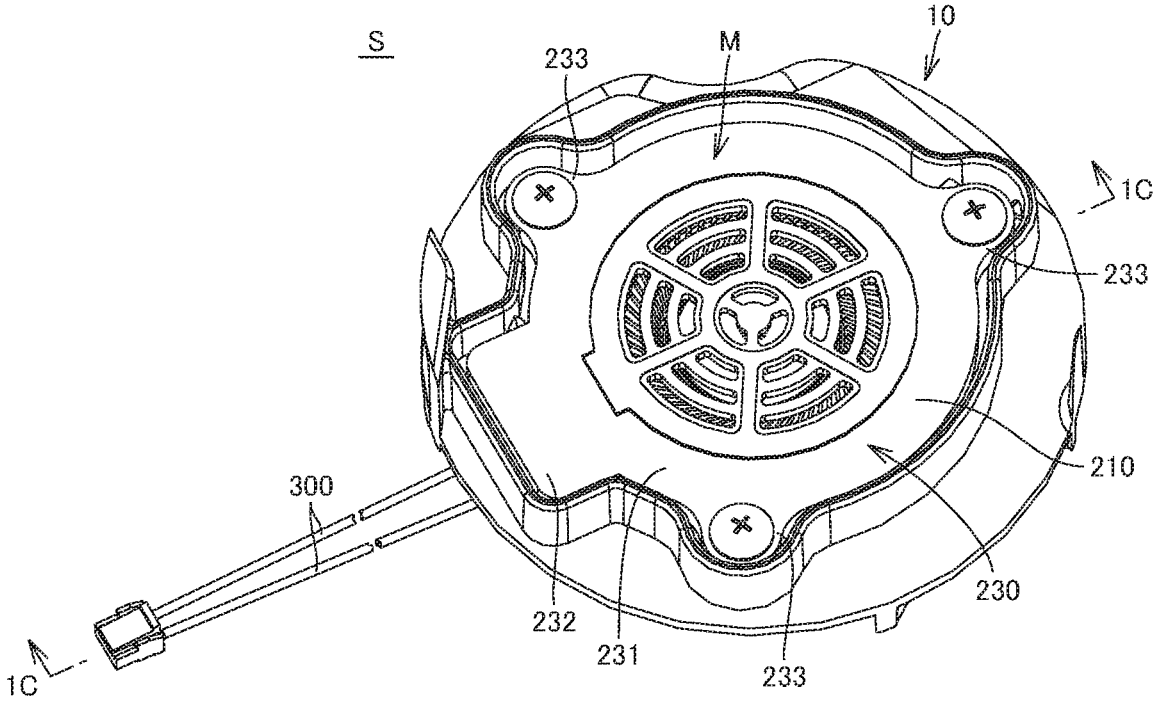
FIG. 1A is a front, top, right side perspective view of a combination of an electronic component module and a casing according to a first embodiment of the invention.
Figure 1B:
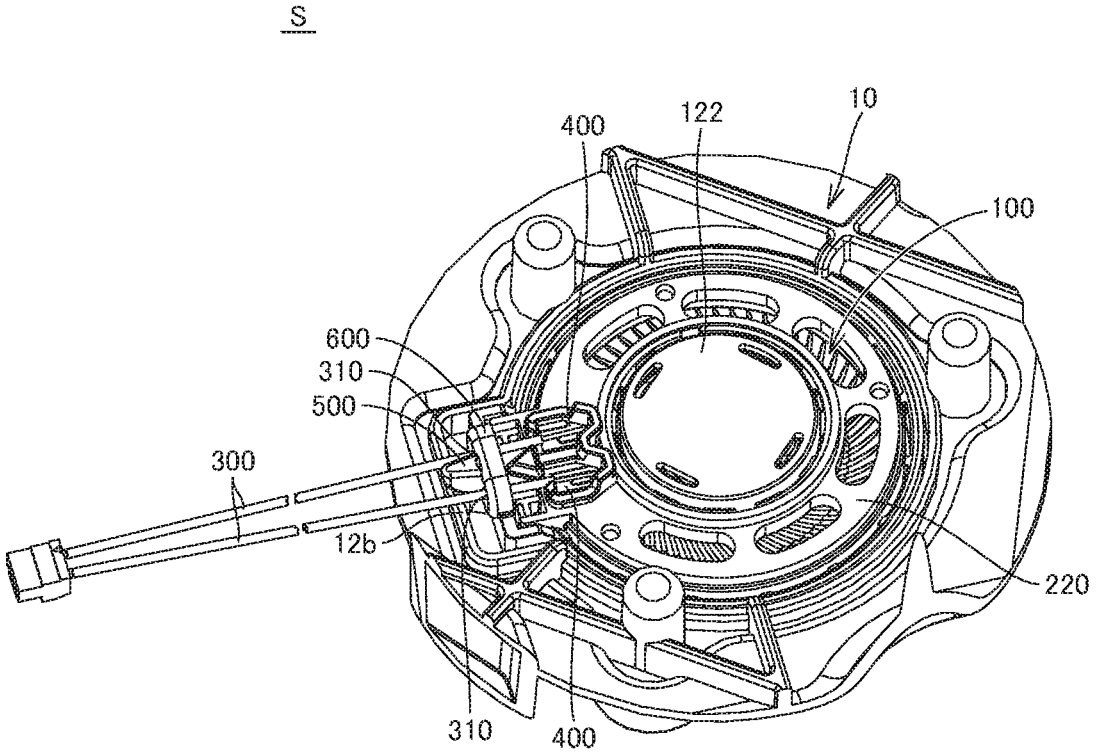
FIG. 1B is a front, bottom, left side perspective view of the combination.
Figure 1C:
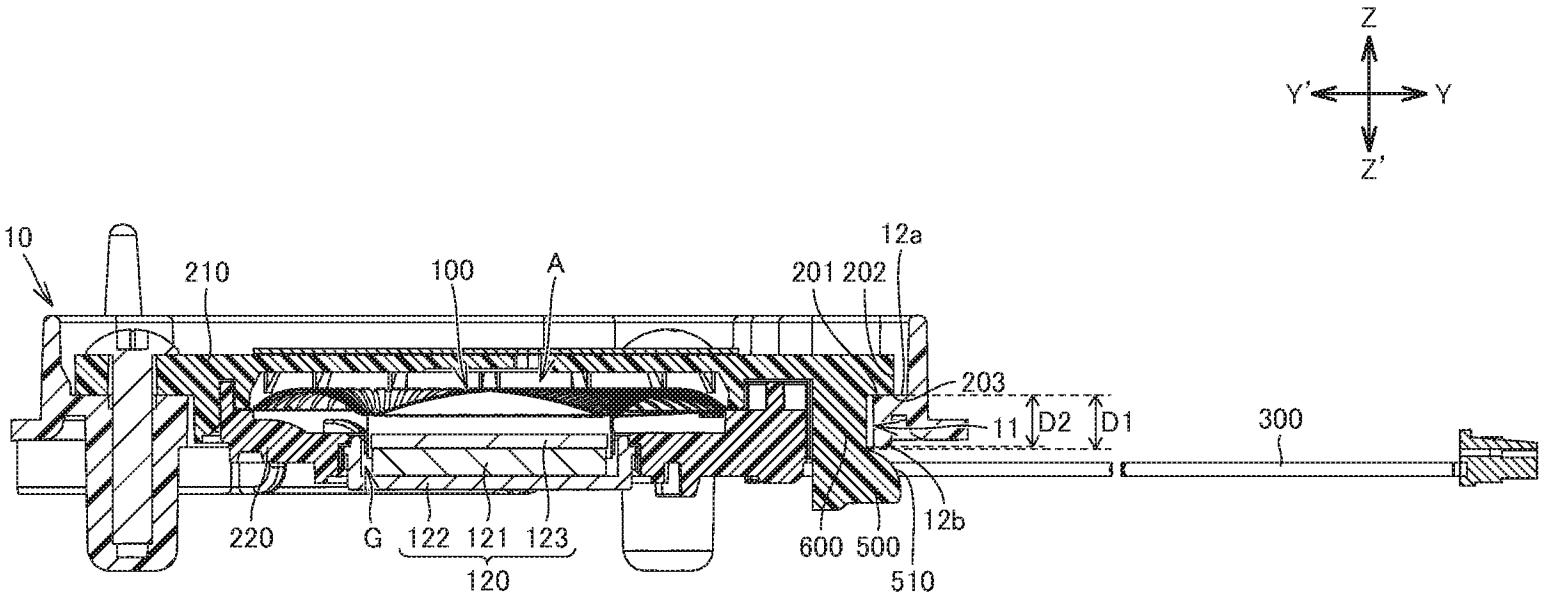
FIG. 1C is a cross-sectional view of the combination, taken along line 1C-1C in FIG. 1A.
Figure 2A:
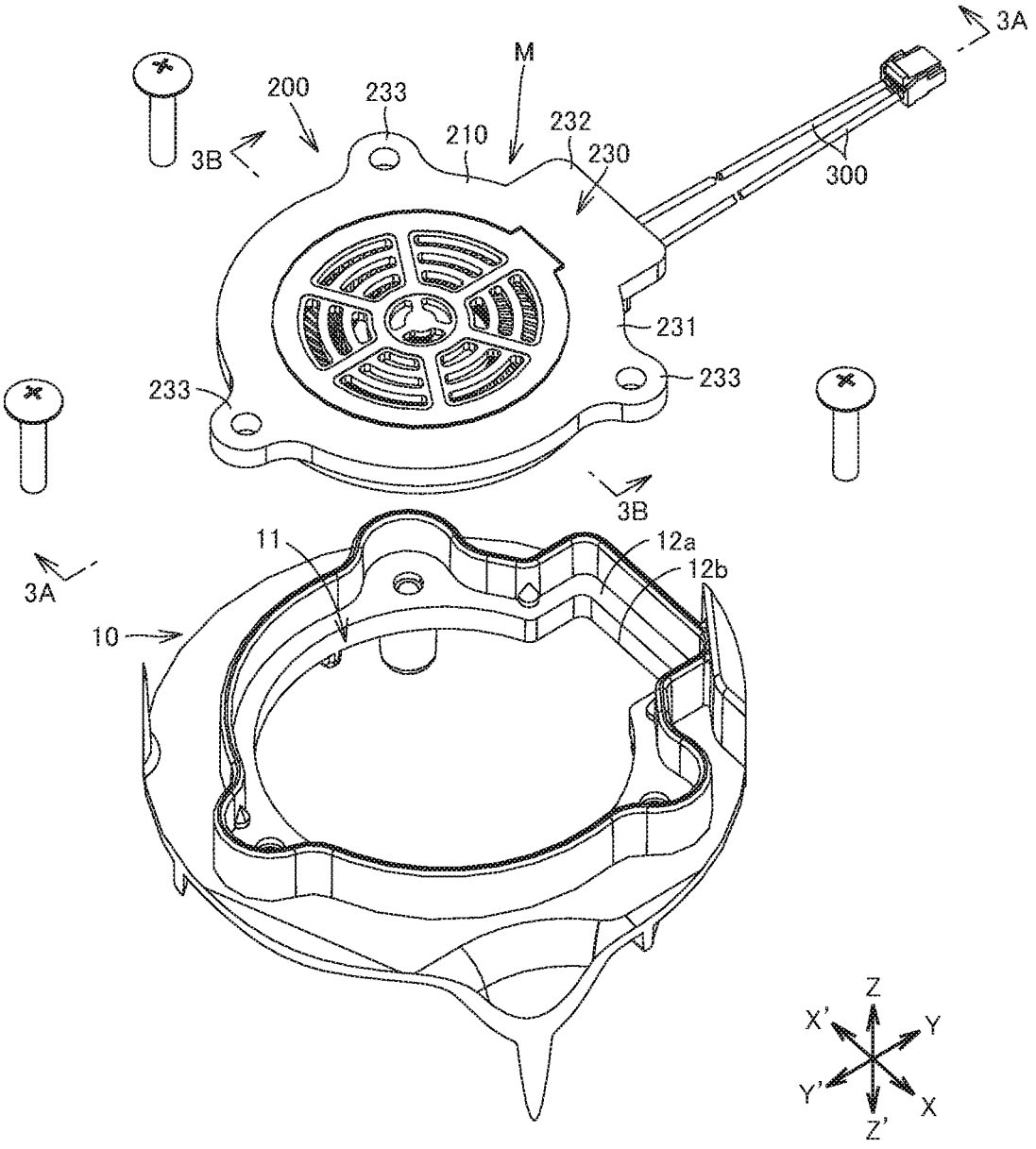
FIG. 2A is a rear, top, left side perspective view of the combination, showing a state before the electronic component module is mounted to the casing.
Figure 2B:
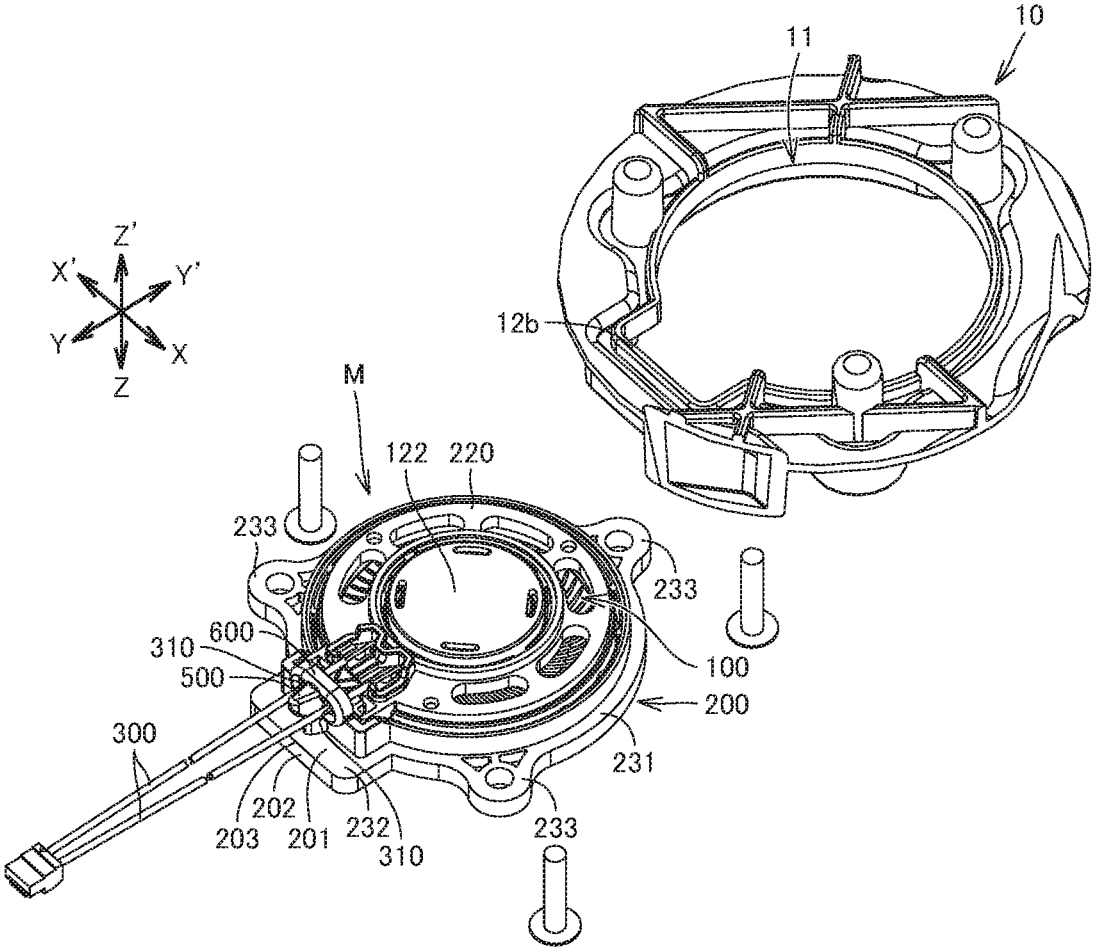
FIG. 2B is a front, bottom, left side perspective view of the combination, showing a state before the electronic component module is mounted to the casing.
Figure 3A:
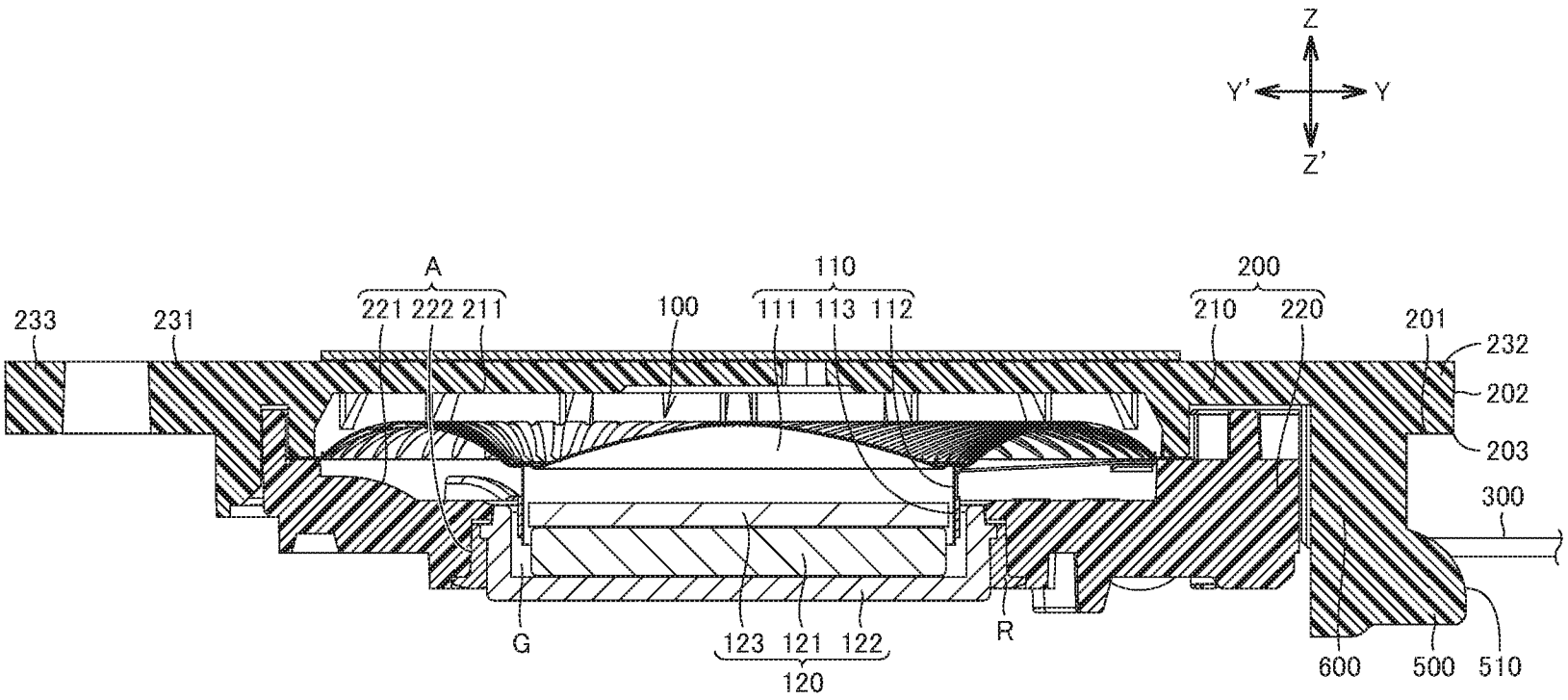
FIG. 3A is an enlarged cross-sectional view of the electronic component module, taken along line 3A-3A cross section in FIG. 2A.
Figure 3B:
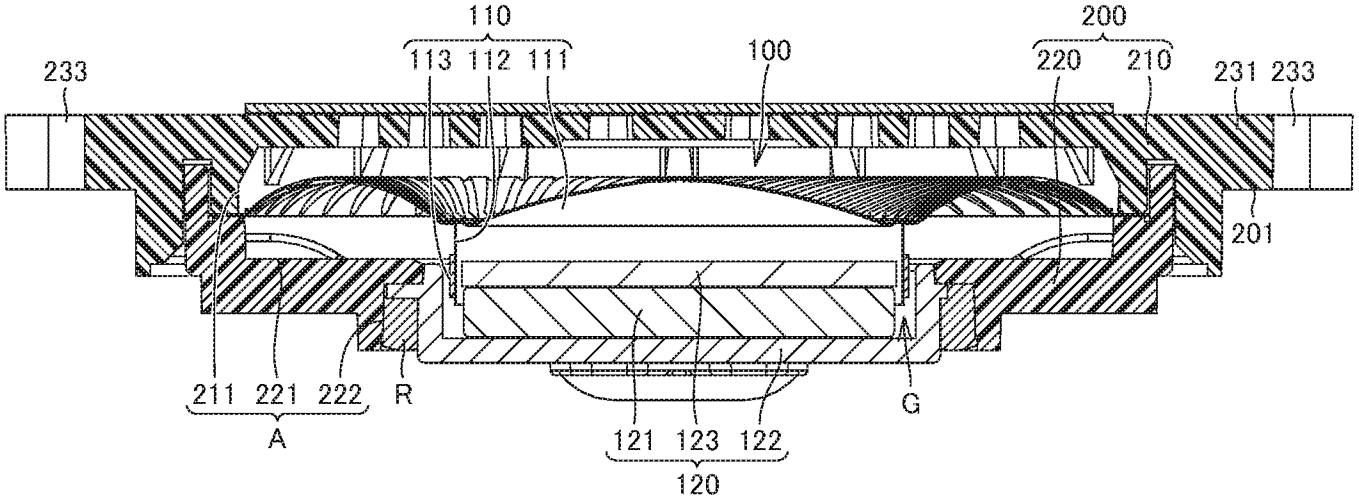
FIG. 3B is an enlarged cross-sectional view of the electronic component module, taken along line 3B-3B in FIG. 2A.
Figure 4A:
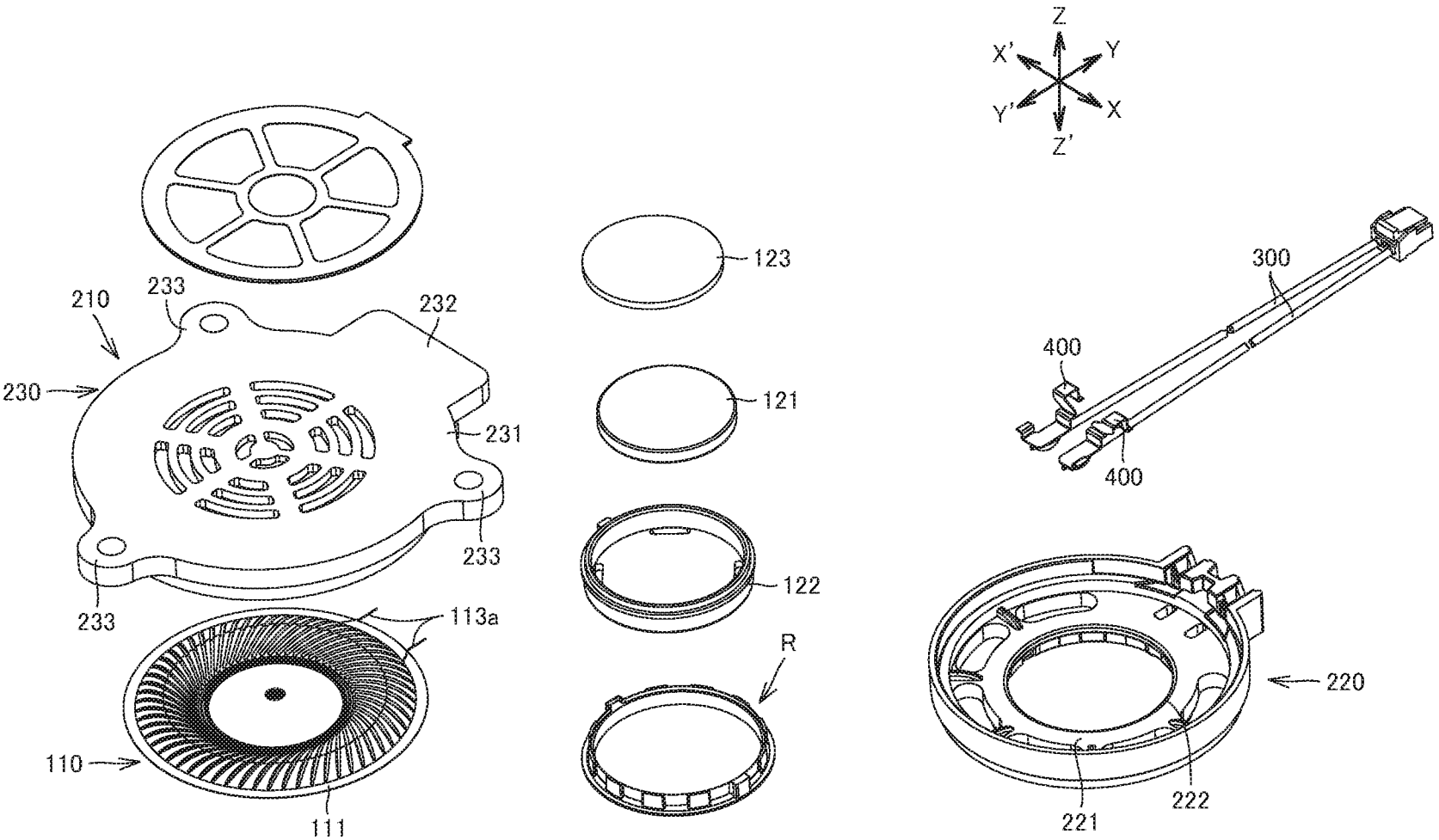
FIG. 4A is an exploded, rear, top, left side perspective view of the electronic component module.
Figure 4B:
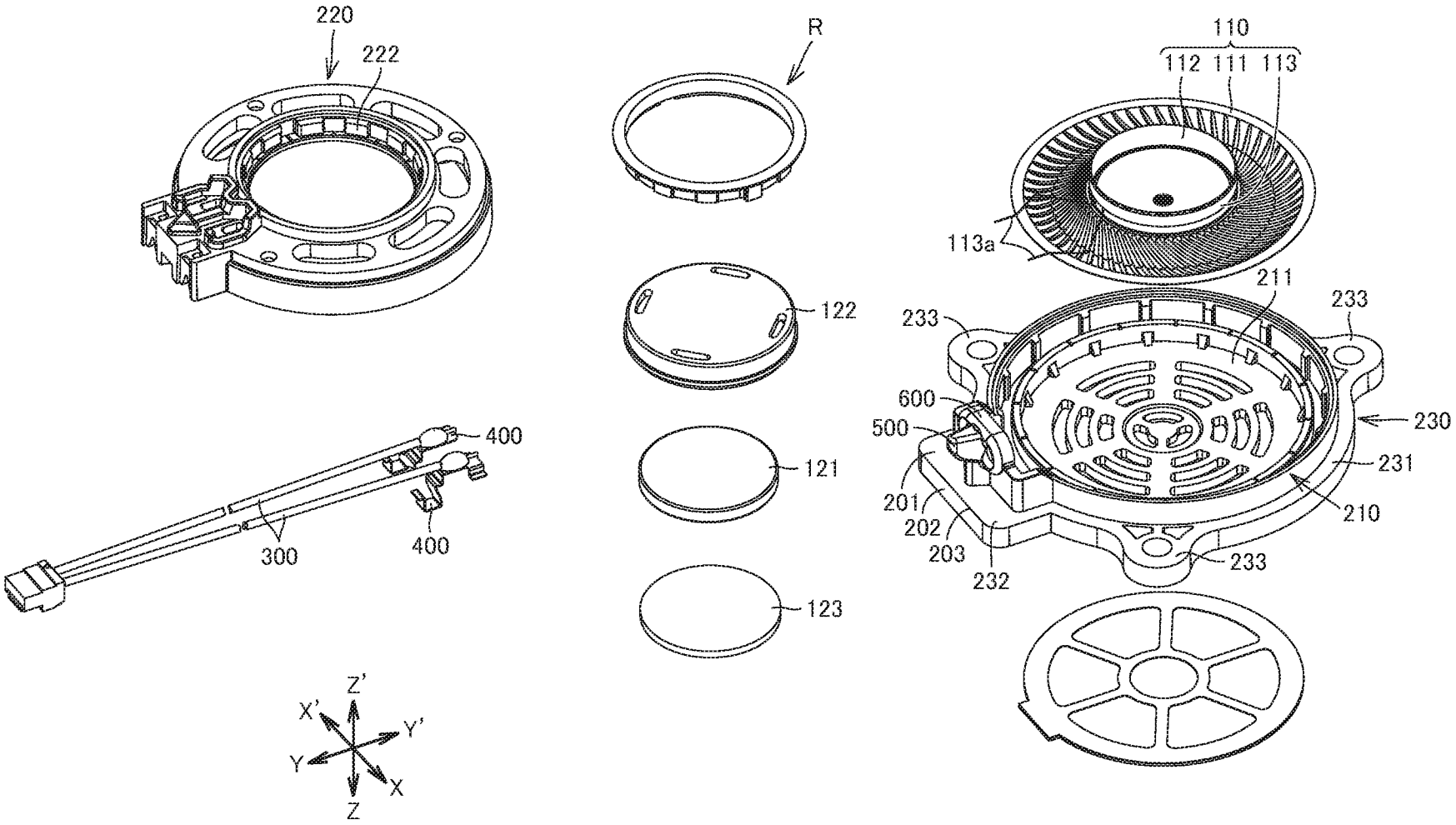
FIG. 4B is an exploded, front, bottom, left side perspective view of the electronic component module.

The at least one protrusion 500 is located on the Z' direction side relative to, and at a distance D1 in the Z-Z' direction from, the abutting face 201 of the frame 200. The distance D1 (distance in the Z-Z' direction from the at least one protrusion 500 to the abutting face 201) may be slightly greater than a distance D2 from the face on the Z-direction side of the first edge portion 12*a* to the second edge portion 12*b* of the casing 10 (see FIG. 1C). Alternatively, the distance D1 may be substantially the same as the distance D2. As shown in FIG. 1C, the distance D1 may be slightly greater than a distance D3 from a face on the Z-direction side of the first edge portion 12*a* to the third edge portion 14 (see FIG. 5). Alternatively, the distance D1 may be substantially the same as the distance D3.

The at least one protrusion 500 may extend in the Y direction, from the inside to the outside relative to the edge line 203 of the frame 200.

Where the portion of the outer face 202 of the frame 200 that is located furthest in the Y direction (this portion may be referred to as a "furthest portion") is located in the Y-Y' direction at the same position as that of the edge line 203 or on the Y'-direction side relative to the edge line 203 (particularly, where the outer face 202 is a vertical face extending in the Z direction from the abutting face 201, or an inclined face inclining in the ZY' direction from the abutting face 201, or a concave face recessed in the Y' direction, for example), the at least one protrusion 500 may extend to the Y-direction side relative to not only the edge line 203 but also the outer face 202.

Where the furthest portion of the outer face 202 is located on the Y-direction side relative to the edge line 203 (particularly, where the outer face 202 is an inclined face inclining in the ZY direction from the abutting face 201, or a face having an arc-shaped section protruding in the Y-direction, or a convex face protruding in the Y direction, or a concave-convex face having a convex portion protruding in the Y-direction, for example), the tip on the Y-direction side of the at least one protrusion 500 may be positioned on the Y'- or Y-direction side relative to the furthest portion of the outer face 202. The tip on the Y-direction side of the at least one protrusion 500 may be positioned along an imaginary line (not shown) extending in the Z-Z' direction from the edge line 203 of the frame 200, or may be positioned inside (on the Y'-direction side) relative to the imaginary line.

The or each protrusion 500 further has an opposing face 510 opposing the abutting face 201. The or each opposing face 510 may curve or incline such that the distance between the opposing face 510 and the abutting face 201 gradually increases in the Y direction. In this case, the top portion of the or each protrusion 500 is the end on the Y'-direction side of the opposing face 510. The opposing face 510 may not curve or incline as described above, but may be a flat face substantially parallel to the abutting face 201. In this case, the top portion of the or each protrusion 500 is the entire opposing face 510.

In the embodiment as shown in FIGS. 1A to 4B, the single protrusion 500 extends in the Y direction from the end face on the Y-direction side of the retainer 600 to the outside relative to the edge line 203, is positioned between the two connection lines 300. Also, the end on the Y'-direction side of the opposing face 510 of the protrusion 500 (the top portion of the protrusion 500) is positioned on the Z-direction side relative to the retained portions 310 of the two connection lines 300, and the face on the Z'-direction side of the protrusion 500 (the bottom portion of the protrusion 500) is positioned on the Z'-direction side relative to the retained portions 310 of the two connection lines 300.

The at least one protrusion 500 may include a plurality of protrusions 500. Where the casing 10 includes the second edge portion 12*b*, one or more protrusions 500 may be provided to be located on the Z'-direction side relative to the second edge portion 12*b* (see FIG. 1C). Where the casing 10 includes a single engaging hole 13 and a third edge portion 14 thereof, one or more protrusions 500 are inserted into the engaging hole 13 of the casing 10 and can be arranged on the Z'-direction side relative to the third edge portion 14 (see FIG. 5). Where the casing 10 includes a plurality of engaging holes 13 and third edge portions 14 thereof, a plurality of protrusions 500 are provided to be received in respective engaging holes 13 of the casing 10 and located on the Z'-direction side relative to the respective third edge portions 14.

Where two protrusions 500 are provided, the protrusions 500 may be spaced apart in the X-X' direction and may be positioned on opposite sides of the one or more connection lines 300 (see FIG. 6). In other words, the one or more connection lines 300 may be arranged between the two protrusions 500.

The following describes a method of mounting the module M including the one or more protrusions 500 to the casing 10 including the housing hole 11, the first edge portion 12*a*, and the second edge portion 12*b*. This method may be hereinafter referred to as a first mounting method.

The casing 10 and the module M are prepared. The module M is tilted in a direction including components of the Z' and Y directions (hereinafter also referred to as a "Z'Y direction") such that the one or more protrusions 500 face the Z'-direction side of the second edge portion 12*b* of the casing 10. In this state, the one or more connection lines 300 of the module M hang down under their own weight and are inserted into the housing hole 11 of the casing 10. The one or more protrusions 500 are then inserted into the housing hole 11 of the casing 10 so as to be positioned on the Z'-direction side relative to the second edge portion 12*b* of the casing 10. With this state maintained, the module M is partly placed into the housing hole 11 of the casing 10, and the abutting face 201 of the frame 200 of the module M is brought into abutment with the first edge portion 12*a* of the housing hole 11 of the casing 10. As a result, the first edge portion 12*a* and the second edge portion 12*b* are positioned between the abutting face 201 and the one or more protrusions 500. The frame 200 of the module M is then fixed to the first edge portion 12*a* of the casing 10 by one of the above-described fixing means, such as screwing, adhesion, fitting, etc.

The following describes a method of mounting the module M including the one or more protrusions 500 to the casing 10 including the housing hole 11, the first edge portion 12*a*, the engaging hole 13 and the third edge portion 14 thereof. This method may be hereinafter referred to as a second mounting method.

The casing 10 and the module M are prepared. The module M is tilted in the Z'Y direction such that the one or more protrusions 500 face the Z'-direction side of the third edge portion 14 of the engaging hole 13 of the casing 10. In this state, the one or more connection lines 300 of the module M hang down under their own weight and are inserted into the housing hole 11 of the casing 10. The one or more protrusions 500 are then inserted into the housing hole 11 of the casing 10, then into the engaging hole 13 of the casing 10, so as to be arranged on the Z'-direction side relative to the third edge portion 14 of the engaging hole 13. With this state maintained, the module M is partly placed into the housing hole 11 of the casing 10, and the abutting face 201 of the frame 200 of the module M is brought into abutment with the first edge portion 12*a* of the housing hole 11 of the casing 10. As a result, the first edge 12*a* and the third edge portion 14 are positioned between the abutting face 201 and the one or more protrusions 500. The frame 200 of the module M is then fixed to the first edge portion 12*a* of the casing 10 by one of the above fixing means, such as screwing, adhesion, fitting, etc.

The following describes a method of mounting the module M including the plurality of protrusions 500 to the casing 10 including the housing hole 11, the first edge portion 12*a*, the plurality of engaging holes 13, and the third edge portions 14 thereof. This method may be hereinafter referred to as a third mounting method.

The casing 10 and the module M are prepared. The module M is tilted in the Z'Y direction such that the protrusions 500 respectively face the Z'-direction sides of the third edge portions 14 of the engaging holes 13 of the casing 10. In this state, the one or more connection lines 300 hang down under their own weight and are inserted into the housing hole 11 of the casing 10. The protrusions 500 are then inserted into the housing hole 11 of the casing 10, then into the respective engaging hole 13 of the casing 10, so as to be arranged on the Z'-direction side relative to the respective third edge portions 14 of the engaging holes 13. With this state maintained, the module M is partly placed into the housing hole 11 of the casing 10, and the abutting face 201 of the frame 200 of the module M is brought into abutment with the first edge portion 12*a* of the housing hole 11 of the casing 10. As a result, the first edge portion 12*a* and the third edge portions 14 are positioned between the abutting face 201 and the protrusions 500. The frame 200 of the module M is then fixed to the first edge portion 12*a* of the casing 10 by one of the above fixing means, such as screwing, adhesion, fitting, etc.

In any of the above mounting methods, if an attempt is made to bring the abutting face 201 of the frame 200 of the module M into abutment with the first edge portion 12*a* of the casing 10 from the Z-direction side by bringing the module M in the Z' direction to be closer to the casing 10 without tilting the module M in the Z'Y direction, the one or more protrusions 500 will abut against abutment with the first edge portion 12*a* of the casing 10 before the one or more connection lines 300 will. This reduces the risk that the one or more connection lines 300 are pinched between the abutting face 201 and the first edge portion 12*a* of the casing 10 and/or between the module M and the side wall of the housing hole 11 of the casing 10.

Figure 7:
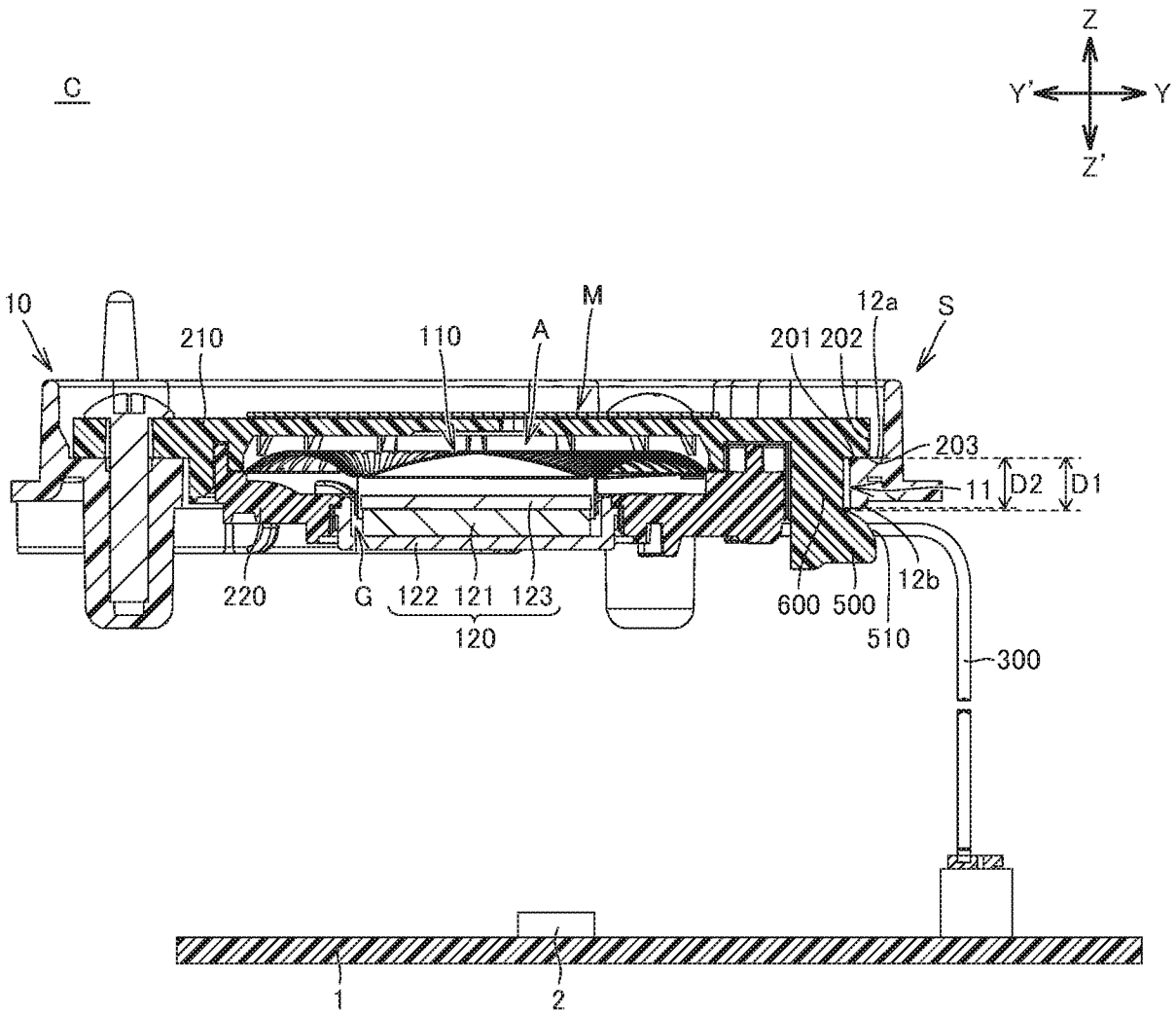
FIG. 7 is a schematic cross-sectional view of a control device according to the first embodiment of the invention.

The following describes a control device C according to the first embodiment of the invention, with reference to FIG. 7. The control device C includes the combination S of any of the above aspects, a main circuit board 1, and a controller 2. The controller 2 is provided on, and connected to, the main circuit board 1. The at least one connection line 300 of the module M of the combination S is connected to the main circuit board 1. Accordingly, the controller 2 is connected to the function part 100 of the module M via the main circuit board 1 and the at least one connection line 300. The controller 2 is configured to output a signal (e.g., a drive signal) to the function part 100 and/or to receive a signal from the function part 100 and execute processing based on the received signal.

Where the function part 100 is a loudspeaker device, the casing 10 may be a casing of a measurement device for use in vehicles and other transports, and the controller 2 of the control device C may be configured to output a drive signal to the function part 100 to notify a state of a vehicle, etc. Some examples of such state are as follows: a seat belt is not fastened; a door of the vehicle, etc. is closed without being properly locked; or the vehicle is traveling at an excessive speed. However, the invention is not limited to these configurations.

The module M, the combination S of the module M and the casing 10, and the control device C including the combination S provide at least the following technical features and effects.

It is possible to reduce the risk that the at least one connection line 300 is pinched between the abutting face 201 and the first edge portion 12*a* of the casing 10 and/or between the module M and the side wall of the housing hole 11 of the casing 10 (this risk may be hereinafter referred to as the risk of pinching the at least one connection line 300). This is because the at least one protrusion 500 is positioned at least partly on the Z-direction side relative to the at least one connection line 300 having been led out in the Y direction. In other words, the at least one connection line 300 having been led out in the Y direction is not positioned in the Z-Z' direction between the at least one protrusion 500 and the abutting face 201. This arrangement allows to mount the module M to the casing 10 by tilting the module M in the Z'Y direction as described above, inserting the at least one connection line 300 into the housing hole 11 of the casing 10, and placing the at least one protrusion 500 on the Z'-direction side relative to the second edge portion 12*b* or the third edge portion 14 of the casing 10. Such mounting manner reduces the risk of pinching the at least one connection line 300.

If an attempt is made to mount the module M to the casing 10 without tilting the module M in the Z'Y direction as described above, the at least one protrusion 500 will abut against the first edge portion 12*a* of the casing 10 before the at least one connection line 300 becomes pinched between the abutting face 201 and the first edge portion 12*a* of the casing 10. This is because the at least one protrusion 500 is positioned at least partly on the Z-direction side relative to the at least one connection line 300 having been led out in the Y direction. It is therefore possible to reduce the risk that the at least one connection line 300 is pinched between the abutting face 201 and the first edge portion 12*a* of the casing 10.

Where the at least one protrusion 500 is partly positioned on the Z' direction side relative to the at least one connection line 300 having been led out in the Y direction, the at least one protrusion 500 will abut against the first edge portion 12*a* before the at least one connection line 300 will. It is therefore possible to further reduce the risk that the at least one connection line 300 is pinched between the abutting face 201 and the first edge portion 12*a* of the casing 10.

Moreover, where the at least one protrusion 500 extends in the Y direction from the inside to the outside relative to the edge line 203 of the frame 200, if an attempt is made to mount the module M to the casing 10 without tilting the module M in the Z'Y direction as described above, the at least one protrusion 500 is more likely to abut against the first edge portion 12*a* before the at least one connection line 300 becomes pinched between the abutting face 201 and the first edge portion 12*a* of the casing 10.

Furthermore, where the module M includes the retainer 600, the at least one protrusion 500 is at least partly positioned in the vicinity of the retained portion 310 of the at least one connection line 300 and on the Z direction side relative to the retained portion 310. This arrangement further reduces the risk that the at least one connection line 300 becomes pinched when tilting the module M in the Z'Y direction as described above to mount the module M to the casing 10.

Where the opposing face 510 of the at least one protrusion 500 curves or inclines such that the distance between the opposing face 510 and the abutting face 201 gradually increases in the Y direction. This arrangement makes it easier to bring the at least one protrusion 500 to the Z direction side of the second edge portion 12*b* or the third edge portion 14 of the casing 10, and also makes it less likely that the at least one protrusion 500 becomes caught by the second edge portion 12*b* or the third edge portion 14 of the casing 10.

Second Embodiment

Figure 8:
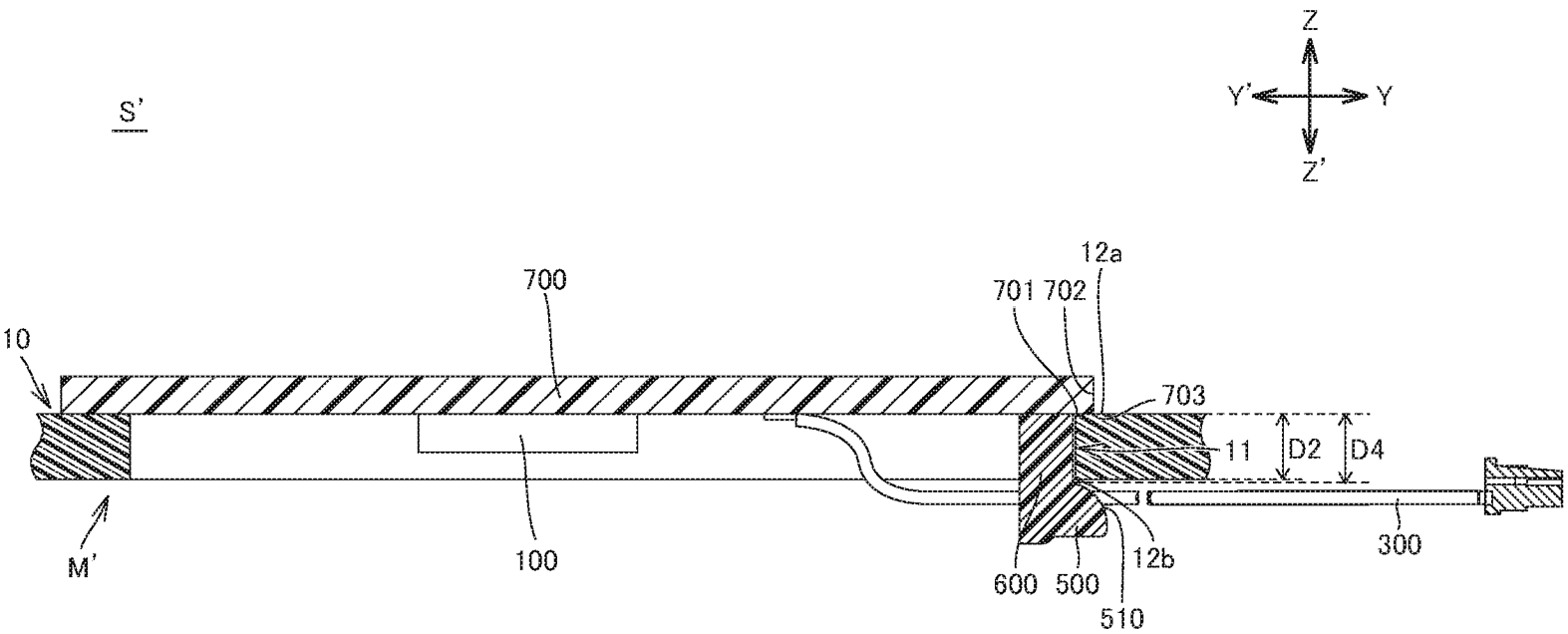
FIG. 8 is a schematic cross-sectional view of the combination of the electronic component module and the casing according to a second embodiment of the invention.

The following describes a combination S' of a casing 10 and an electronic component module M' according to a plurality of embodiments including the second embodiment of the invention, with reference to FIG. 8. FIG. 8 shows the combination S' of the second embodiment. FIG. 8 also shows the Z-Z' and Y-Y' directions.

The combination S' may have the same configuration as that of the combination S, except that the casing 10 has an outer shape that is different from that of the casing 10 of the combination S, and that the module M' includes a circuit board 700 (fixing part) in place of the frame 200. The combination S' will now be described focusing on the differences from the combination S and omitting overlapping descriptions.

The casing 10 of the combination S' has an outer shape that is different from that of the casing 10 of the combination S, but otherwise may have the same configuration as that of the casing 10 of any of the aspects described above.

The circuit board 700 may be a single-layer circuit board. The circuit board 700 may alternatively be a multi-layer circuit board having a plurality of layers laminated together. The function part 100 is fixed to the circuit board 700. More particularly, the circuit board 700 may be configured such that the function part 100 is mounted on the face on the Z' direction side of the circuit board 700, or that the function part 100 is fixed to and between two adjacent ones in the Z-Z' direction of the layers of the circuit board 700.

The circuit board 700 may include a body and at least one flange. The body may include a portion to fix the function part 100 of the circuit board 700. The body has a greater dimension in the Z-Z' direction than the or each flange. The at least one flange extends from the body, at least in the Y direction. For example, the at least one flange may have a configuration similar to any of configurations (a) to (d) described above, or may have a configuration similar to the flange 230 shown in FIGS. 1A to 4B.

The circuit board 700 further includes an abutting face 701, an outer face 702, and an edge line 703 along which the abutting face 701 and the outer face 702 meet. The abutting face 701 is a face that is abuttable, from the Z-direction side, with the first edge portion 12*a* of the casing 10 of the circuit board 700. With the abutting face 701 abutting the first edge portion 12*a* of the casing 10, the circuit board 700 is fixed to the first edge portion 12*a* by any of the above fixing means. The outer face 702 faces generally to the Y-direction side and may particularly be a flat face, a face having an arc-shaped section, a concave face, a convex face, a concave-convex face, or other face. The outer face 702 extends from an end of the abutting face 701, generally in a direction including a component of the Z direction. Particularly, the outer face 702 may extend orthogonally to the abutting face 701. Alternatively, the outer face 702 may extend diagonally to the abutting face 701, in a ZY or ZY' direction. The Z-Z' direction is substantially orthogonal to the abutting face 701.

Where the circuit board 700 includes no flanges, the outer perimeter portion of the circuit board 700 may include the abutting face 701, the outer face 702, and the edge line 703.

Where the circuit board 700 includes the at least one flange, the at least one flange may include the abutting face 701, the outer face 702, and the edge line 703. The abutting face 701, the outer face 702, and the edge line 703 of the at least one flange of the circuit board 700 may have similar configurations to those of the abutting face 201, the outer face 202, and the edge line 203, respectively, of the at least one flange 230 of the frame 200 of any of the aspects described above.

The module M' further includes the at least one connection line 300. The at least one connection line 300 may have the same configuration as that of the at least one connection line 300 of any of the above-described aspects of the module M, except that the at least one connection line 300 of the module M' is positioned on the Z' direction side relative to the abutting face 701 of the circuit board 700, not relative to the abutting face 201 of the frame 200. The at least one connection line 300 may be connected directly to the function part 100, or indirectly to the function part 100 via the circuit board 700. In the embodiment as shown in FIG. 8, there are two connection lines 300 (one of them is shown), which are connected to the circuit board 700 and connected to the function part 100 via the circuit board 700.

The module M' may further include the retainer 600. The retainer 600 may have the same configuration as that of the retainer 600 of any of the above-described aspects of the module M, except the following differences.

The retainer 600 may be provided integrally with the function part 100 or the circuit board 700. Alternatively, the retainer 600 may be provided separately from the function part 100 or the circuit board 700 and may be fixed to the function part 100 or the circuit board 700 by any of the above fixing means.

The retainer 600 is positioned on the Z' direction side relative to the abutting face 701 of the circuit board 700, and retains the one or more connection lines 300 partly such that the one or more connection lines 300 are led out in the Y direction, from the inside to the outside relative to the edge line 703 of the circuit board 700. The retainer 600 can be omitted in the module M'.

The module M' further includes the at least one protrusion 500. The at least one protrusion 500 may have the same configuration as that of the at least one protrusion 500 of the module M of any of the above-described aspects, except the following differences.

The at least one protrusion 500 may be provided integrally with the function part 100 or the circuit board 700. Alternatively, the at least one protrusion 500 may be provided separately from the function part 100 or the circuit board 700 and may be fixed to the function part 100 or the circuit board 700 by any of the above fixing means. The at least one protrusion 500 may have any of configuration (iii) above, configuration (iv) below, or configuration (v) below.

(iv) Where the circuit board 700 includes the body, the or each protrusion 500 is provided on an outer face on the Y- or Z'-direction side of the body of the circuit board 700.

(v) The or each protrusion 500 has a first portion extending in the Z' direction from the abutting face 701 of the circuit board 700 and a second portion extending in the Y direction from the first portion.

Even where the module M' includes the retainer 600, the at least one protrusion 500 may have configuration (iv) or (v) and be positioned in the vicinity of the retained portion 310 of the at least one connection line 300.

The at least one protrusion 500 located on the Z' direction side relative to, and at a distance D4 in the Z-Z' direction from, the abutting face 701 of the circuit board 700. The distance D4 (distance in the Z-Z' direction from the at least one protrusion 500 to the abutting face 701) may be slightly greater than the distance D2 from the face on the Z direction side of the first edge portion 12*a* to the second edge portion 12*b* of the casing 10 (see FIG. 8). Alternatively, the distance D1 may be substantially the same as the distance D2. The distance D4 may be slightly greater than the distance D3 from the face on the Z direction side of the first edge portion 12*a* to the third edge portion 14 (see FIG. 5 for reference purpose). The at least one protrusion 500 extends in the Y direction, from the inside to the outside relative to the edge line 703 of the circuit board 700.

The module M' of any of the above-described aspects is mounted to the casing 10 in a manner similar to one of the first to third mounting methods for the module M. It is to be noted here that in each of the first to third mounting methods, the frame 200, the abutting face 201, the outer face 202, and the edge line 203 are replaced with the circuit board 700, the abutting face 701, the outer face 702, and the edge line 703.

The control device C may include the combination S' in place of the combination S.

The module M', the combination S' of the module M' and the casing 10, and the control device C including the combination S' provide the same technical features and effects as those of the module M, the combination S, and the control device C including the combination S.

The electronic component module, the combination of the electronic component module and the casing, and the control device described above are not limited to the embodiments described above but may be modified in any manner within the scope of the claims. Some example modifications will be described below.

The at least one protrusion of any of the above aspects is only required to extend in the Y direction at least partly. Thus, the at least one protrusion of any of the above aspects may extend partly in the ZY and/or Z'Y directions. In this case, the ZY or Z'Y direction corresponds to the third direction.

The at least one engaging portion of the casing of the invention is not limited to the third edge portion 14 of the engaging hole 13 but may be modified as follows, for example. The at least one engaging portion may be an edge portion on the Z direction side of an engaging recess in the or a side wall of the housing hole 11 of the casing 10 (i.e. in the or an inner wall of the casing 10). The at least one engaging portion may be an engaging projection extending in the Y' direction from the or a side wall of the housing hole 11 of the casing 10 and positioned on the Z' direction side relative to the first edge portion 12*a*. The at least one protrusion 500 of any of the above aspects may preferably configured such that, with the abutting face 201 abutting the first edge portion 12*a* of the housing hole 11 of the casing 10, the at least one protrusion 500 be positioned on the Z' direction side relative to the edge portion on the Z direction side of the at least one engaging recess, or relative to the at least one engaging projection.

The materials, the shapes, the dimensions, the numbers, the positions, etc. of the elements of the electronic component module, the combination of the electronic component module and the casing, and the control device in the above-described embodiments and their variants are presented by way of example only and can be modified in any manner as long as the same functions can be fulfilled. The conditions, the numerical values, the materials, etc. of the mounting methods of various aspects and their modifications of the embodiments have been described by way of example only, and they may be modified in any manner as long as similar processes can be performed. The Z direction (first direction) of the invention may any direction substantially orthogonal to the abutting face of the frame or to the abutting face of the circuit board of the invention. The Z' direction (second direction) of the invention may be any direction opposite to the first direction. The third direction of the invention may be any direction that crosses the first and second directions.

The present invention can include any combination of these various features or embodiments above and/or below as set-forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

REFERENCE SIGNS LIST

C: control device
1: main circuit board
2: controller
S, S': combination
10: casing
11: housing hole
12*a*: first edge portion
12*b*: second edge portion
13: engaging hole
14: third edge portion
M, M': electronic component module
100: function part
200: frame (fixing part)
201: abutting face
202: outer face
203: edge line
210: first frame
220: second frame
230: flange
300: connection line
310: retained portion
400: terminal
500: protrusion
510: opposing face
600: retainer
700: circuit board (fixing part)
701: abutting face
702: outer face
703: edge line

What is claimed is:

1. An electronic component module comprising:

a fixing part being a frame or a circuit board, the fixing part including:

an abutting face, an outer face extending from an end of the abutting face in a direction including a component of a first direction, the first direction being substantially orthogonal to the abutting face, and an edge line along which the abutting face and the outer face meet;

a function part housed in, or fixed to, the fixing part, the function part being configured to function as an electronic component;

at least one connection line being flexible, electrically connected to the function part, positioned on a second direction side relative to the abutting face of the fixing part, and configured to be led out from an inside to an outside relative to the edge line of the fixing part to extend in a third direction, wherein the second direction is opposite to the first direction and the third direction crosses the first and second directions; and at least one protrusion being provided on the function part or the fixing part, extending at least partly in the third direction, and being positioned at least partly on the first direction side relative to the at least one connection line having been led out in the third direction.

2. The electronic component module according to claim 1, wherein the at least one protrusion is partly positioned on the second direction side relative to the at least one connection line having been led out in the third direction.

3. The electronic component module according to claim 2, wherein the at least one protrusion extends in the third direction, from an inside to an outside relative to the edge line of the fixing part.

4. The electronic component module according to claim 3, wherein the electronic component further comprises a retainer positioned on the second direction side relative to the abutting face, the retainer retains the at least one connection line partly such that the at least one connection line is led out in the third direction from an inside to an outside relative to the edge line, the at least one connection line includes a retained portion to be retained by the retainer, and the at least one protrusion is positioned in a vicinity of the retained portion of the at least one connection line and at least partly positioned on the first direction side relative to the retained portion of the at least one connection line.

5. The electronic component module according to claim 2, wherein the electronic component further comprises a retainer positioned on the second direction side relative to the abutting face, the retainer retains the at least one connection line partly such that the at least one connection line is led out in the third direction from an inside to an outside relative to the edge line, the at least one connection line includes a retained portion to be retained by the retainer, and the at least one protrusion is positioned in a vicinity of the retained portion of the at least one connection line and at least partly positioned on the first direction side relative to the retained portion of the at least one connection line.

6. The electronic component module according to claim 2, wherein the at least one protrusion includes an opposing face opposing the abutting face, and the opposing face of the at least one protrusion curves or inclines such that a distance between the opposing face and the abutting face gradually increases in the third direction.

7. The electronic component module according to claim 1, wherein the at least one protrusion extends in the third direction, from an inside to an outside relative to the edge line of the fixing part.

8. The electronic component module according to claim 7, wherein the at least one protrusion extends further in the third direction than the outer face of the fixing part.

9. The electronic component module according to claim 3, wherein the electronic component further comprises a retainer positioned on the second direction side relative to the abutting face, the retainer retains the at least one connection line partly such that the at least one connection line is led out in the third direction from an inside to an outside relative to the edge line, the at least one connection line includes a retained portion to be retained by the retainer, and the at least one protrusion is positioned in a vicinity of the retained portion of the at least one connection line and at least partly positioned on the first direction side relative to the retained portion of the at least one connection line.

10. The electronic component module according to claim 7, wherein the at least one protrusion includes an opposing face opposing the abutting face, and the opposing face of the at least one protrusion curves or inclines such that a distance between the opposing face and the abutting face gradually increases in the third direction.

11. The electronic component module according to claim 1, wherein the fixing part further includes a flange having the abutting face, the outer face, and the edge line.

12. The electronic component module according to claim 1, wherein the electronic component further comprises a retainer positioned on the second direction side relative to the abutting face, the retainer retains the at least one connection line partly such that the at least one connection line is led out in the third direction from an inside to an outside relative to the edge line, the at least one connection line includes a retained portion to be retained by the retainer, and the at least one protrusion is positioned in a vicinity of the retained portion of the at least one connection line and at least partly positioned on the first direction side relative to the retained portion of the at least one connection line.

13. The electronic component module according to claim 12, wherein the retainer is provided on the fixing part, and the at least one protrusion is not provided on the function part or the fixing part, but on the retainer.

14. The electronic component module according to claim 1, wherein the at least one connection line comprises a plurality of connection lines, and the or each protrusion is positioned between two of the connection lines.

15. The electronic component module according to claim 1, wherein the at least one protrusion comprises two protrusions arranged on opposite sides of the at least one connection line.

16. The electronic component module according to claim 1, wherein the at least one protrusion includes an opposing face opposing the abutting face, and the opposing face of the at least one protrusion curves or inclines such that a distance between the opposing face and the abutting face gradually increases in the third direction.

17. A combination of an electronic component module and a casing, the combination comprising:

the electronic component module according to claim 1; and a casing, the casing including:

a housing hole opening to the first direction side, a first edge portion of the housing hole on the first direction side, and a second edge portion of the housing hole on the second direction side, wherein the first and second edge portions are positioned between the abutting face and the at least one protrusion in a state where the electronic component module is partly housed in the housing hole from the first direction side and the abutting face of the electronic component module abuts the first edge portion of the housing hole from the first direction side.

18. A control device comprising:

the combination according to claim 17;

a main circuit board positioned on the second direction side relative to the casing and connected to the at least one connection line of the electronic component module; and a controller mounted on the main circuit board and configured to output a signal to, and/or receive a signal from, the function part of the electronic component module via the main circuit board and the at least one connection line.

19. A combination of an electronic component module and a casing, the combination comprising:

the electronic component module according to claim 1; and a casing, the casing including:

a housing hole opening to the first direction side, a first edge portion of the housing hole on the first direction side, a side wall of the housing hole, and at least one engaging portion provided on the side wall of the housing hole and positioned on the second direction side relative to the first edge portion, wherein the first edge portion and the engaging portion are positioned between the abutting face and the at least one protrusion in a state where the electronic component module is partly housed in the housing hole from the first direction side and the abutting face of the electronic component module abuts the first edge portion of the housing hole from the first direction side.

20. A control device comprising:

the combination according to claim 19;

a main circuit board positioned on the second direction side relative to the casing and connected to the at least one connection line of the electronic component module; and a controller mounted on the main circuit board and configured to output a signal to, and/or receive a signal from, the function part of the electronic component module via the main circuit board and the at least one connection line.

* * * * *